US006886476B2

(12) United States Patent
Katsui

(10) Patent No.: US 6,886,476 B2
(45) Date of Patent: May 3, 2005

(54) VERTICAL REFUSE INCINERATOR FOR INCINERATING WASTES AND METHOD FOR CONTROLLING THE SAME

(75) Inventor: Seizo Katsui, Osaka (JP)

(73) Assignee: Plantec Inc., Osaka (JP)

( * ) Notice: Subject to any disclaimer, the term of this patent is extended or adjusted under 35 U.S.C. 154(b) by 0 days.

(21) Appl. No.: 10/641,145

(22) Filed: Aug. 15, 2003

(65) Prior Publication Data

US 2005/0039647 A1 Feb. 24, 2005

(30) Foreign Application Priority Data

Mar. 28, 2003 (JP) ..... 2003-091244

(51) Int. Cl.[7] ..... F23G 5/00; F23B 5/00

(52) U.S. Cl. ..... 110/255; 110/185; 110/259; 110/346; 110/235; 110/213; 110/214

(58) Field of Search ..... 110/190, 185, 110/186, 297, 300, 346, 235, 233, 165 R, 166, 213, 214, 250, 259

(56) References Cited

U.S. PATENT DOCUMENTS 5,127,344 A * 7/1992 Katsui ..... 110/255
5,205,695 A * 4/1993 Katsui ..... 414/196

FOREIGN PATENT DOCUMENTS

| | | | |
|---|---|---|---|
| JP | 64-41709 | 2/1989 | |
| JP | 4-158110 | 6/1992 | |
| JP | 410068515 | * 3/1998 | ..... F23G/5/50 |
| JP | 2000220815 | * 8/2000 | ..... F23G/7/04 |
| JP | 2001021129 | * 1/2001 | ..... F23J/1/00 |
| JP | 2001-304519 | 10/2001 | |
| JP | 2002-243127 | 8/2002 | |

* cited by examiner

*Primary Examiner*—Kenneth Rinehart
(74) *Attorney, Agent, or Firm*—Armstrong, Kratz, Quintos, Hanson & Brooks, LLP

(57) ABSTRACT

In a vertical refuse incinerator for incinerating wastes according to the present invention, an incinerator body 1 is made up of an upper cylindrical part CP and a lower funnel part FP covered by a cooling case, and an exhaust gas mixing device 4 promoting the mixing and secondary combustion of combustion gas stream CG is provided between a flame zone FZ and a re-combustion chamber 45. On the other hand, completely incinerated bottom ash is discharged below the incinerator body 1 by the opening and closing operations of a bottom ash discharge device DD by cooled refuse supporting means RS and bottom ash discharge plates 35.

8 Claims, 10 Drawing Sheets

VERTICAL REFUSE INCINERATOR FOR INCINERATING WASTES AND METHOD FOR CONTROLLING THE SAME

BACKGROUND OF THE INVENTION

1. Field of the Invention

The present invention relates to vertical refuse incinerators for incinerating wastes having a wide variety of properties, in particular, industrial wastes including medical wastes, and to methods for controlling the same.

2. Related Art

Industrial wastes contain not only many hazardous materials, but also materials with a high heating value and hard-to burn materials or incombustible materials. In addition, industrial wastes occurs in a wide variety of shapes, such as solid, liquid and viscous, so that it has been extremely difficult to completely dispose of such industrial wastes with conventionally used fixed grate batch type incinerators.

For incineration of medical wastes having a wide variety of properties and including hazardous infectious materials containing pathogenic viruses and easily meltable materials such as glass, for example, rotary kiln type incinerators, inclined rotary hearth type incinerators, horizontal rotary hearth type incinerators equipped with agitating means are commonly used. Since each of these incinerators uses a method in which wastes are burnt while being turned and agitated, this causes uneven combustion, or only flammable materials to be burnt first to result in a burnout of the grate portion, and hard-to burn materials remain unburnt. This has made it impossible to perform the complete combustion and sterilization of wastes, leading to the problem of not being able to prevent, in particular, the generation of dioxins due to incomplete combustion and the discharge of unburnt materials. The method in which refuse is incinerated while being agitated has also caused such deficiencies as an increased generation of dioxins due to the catalysis of fly ash generated in large amounts. Furthermore, there has been the problem that glasses are melted and attached to the outlet portion of the incinerators, thus making it impossible to continue the operation.

In the case of incinerating gereral wastes having a wide variety of properties, there have been also problems similar to those described above, such as the burnout of the grate portion, incomplete combustion and the generation of dioxins.

FIG. 10 is a vertical sectional view schematically showing the "Vertical incinerator and incineration method thereof" disclosed in Japanese Laid-Open Patent Publication No. Hei 4-158110, which is related art that solves the above-described problems.

Referring to FIG. 10, a combustion gas exhaust port 206 is mounted at the top of an incinerator body 201, and a hopper 202 having a feeder and an ignition burner 203 are provided at the upper portion. Inside the incinerator body 201, retractable refuse supporting plates 204 are provided at the lower portion, and closable bottom ash discharge plates 205 are arranged at the bottom.

As shown in FIG. 10, the refuse supporting plates 204 are usually arranged in positions that are retracted from the inside of the incinerator body 201, and are projected into an upper portion of an ash layer AL so as to support the load of refuse and bottom ash located above the refuse supporting plates 204 only when the bottom ash discharge plates 206 are opened so as to discharge bottom ash, as indicated by the dash-dotted line in FIG. 10.

On both sides of the incinerator body 201 where the refuse supporting plates 204 are located, compartments 210 are provided for housing the refuse supporting plates 204 when the refuse supporting plates 204 are retracted from the inside of the incinerator body 201.

A room-temperature cooling air stream CA is supplied to the compartments 210, and the cooling air stream CA is jetted into the incinerator body 201 from clearances 211 formed between the incinerator body 201 and the compartments 210, cooling the refuse supporting plates 204, while preventing bottom ash in the incinerator body 201 from entering into the compartments 210 from the clearances 211.

The bottom ash discharge plates 206 are closably provided at the bottom of the incinerator body 201 such that they can be opened and closed between a horizontal position and the vertical position indicated by the dash-dotted line. By turning the bottom ash discharge plates 205 downward after supporting the layers located above the upper portion of the ash layer AL in the lower portion of the incinerator body 201 with the refuse supporting plates 204, the incinerated bottom ash BA can be carried out to an ash removal conveyor 212 provided below the incinerator body 201.

That is to say, the refuse supporting plates 204 are provided to assist the bottom ash discharge plates 205 in discharging the bottom ash BA.

In addition, combustion air streams A1, A2 and A3 whose temperatures are adjusted are supplied via dampers 221, 222 and 223 to the upper, middle and lower portions of the incinerator body 201, respectively. The temperature of each of the combustion air streams A1, A2 and A3 is adjusted to an optimal temperature in accordance with the property of the refuse.

The ignition burner 203 mounted on the side of the incinerator body 201 that is opposite from the side where the hopper 202 is provided is used to ignite refuse at the time of start-up or to aid combustion when the temperature inside the incinerator is low.

Next, a method for incinerating refuse with a vertical incinerator having the above-described structure is described.

Here, in the incinerator body 201 at normal operation, a flame zone FZ, a refuse layer RL, a glow layer GL and an ash layer AL are formed from top to bottom in this order. The positions of these layers move, depending on the combustion state of refuse rising successively from the lower layer.

Refuse supplied from the hopper 202 into the incinerator body 201 is deposited on the ash layer AL located at the bottom of the incinerator body 201 at the period of start-up, and heated by the ignition burner 203 and its combustion is started with the combustion air streams A1 and A2. Then, flammable refuse is incinerated to ash first and deposited in the glow layer GL along with hard-to burn refuse, while retaining the embers.

If refuse is supplied in this state, the refuse is deposited in the refuse layer RL, and the flammable materials start to ignite first with the heat of the glow layer GL and the combustion air stream A1. Then, the combustion gradually extends throughout the refuse layer RL, shifting the operation to its normal state.

During this combustion, a combustion gas stream CG generated in the glow layer GL and a lower portion of the refuse layer RL passes through the refuse layer RL and rises, promoting the ignition and gasification of refuse located thereabove and drying garbage with its heat.

Further, the combustion gas stream CG that has risen to the flame zone FZ is reburnt with a room-temperature secondary air stream SA supplied thereabove, and then discharged as exhaust gas from the combustion gas exhaust port 206 for the next step.

The radiation heat generated during this re-combustion of the combustion gas stream CG in the flame zone FZ is used to perform a preliminary drying of refuse charged into the refuse layer RL and to burn paper or plastic, each having a low ignition point, promoting these materials to become the embers.

After completion of the combustion in the ash layer AL, the refuse supporting plates 204 are projected into the upper portion of the ash layer AL in the incinerator body 201 so as to support the load of the bottom ash BA and refuse in the refuse layer RL, the glow layer GL and the upper portion of the ash layer AL that are located above the refuse supporting plates 204.

At the time of this projection, the combustion of refuse has been completed in the positions where the refuse supporting plates 204 are located, so that the refuse supporting plates 204 can be smoothly projected, with little resistance due to the refuse.

After projecting the refuse supporting plates 204 in this manner, the bottom ash discharge plates 205 are turned downward so as to drop the bottom ash BA in a discharge area DA that is located below the refuse supporting plates 204, into the ash removal conveyor 212.

After discharging the bottom ash BA, the bottom ash discharge plates 205 are turned upward to be restored, and then the refuse supporting plates 204 are retracted from the inside of the incinerator body 201 into the compartments 210 so as to drop the remaining bottom ash BA located above the refuse supporting plates 204 and the incineration residue in the glow layer GL, onto the bottom ash discharge plates 205 at the bottom, while also successively dropping the refuse layer RL.

The shock generated during the dropping not only improves the air permeability of the ash layer AL, but also breaks up lump of unburnt materials in the glow layer GL and the refuse layer RL, which improves the air permeability of the layers and allows air to pass through the inside of the lump. Accordingly, when the high-temperature combustion air streams A2 and A3 are supplied, the unburnt materials in the bottom ash BA can be readily burnt with the retained embers.

However, it is difficult to perform the complete combustion and sterilization of industrial wastes, in particular, medical wastes, with the conventional vertical incinerator. The reason is that such wastes contain materials with a high heating value and hard-to burn materials or incombustible materials and have a variety of properties, causing violent fluctuation in the temperature inside the incinerator and thus resulting in unstable combustion.

Additionally, the secondary combustion in the flame zone FZ is not performed completely in the vertical incinerator shown in FIG. 10, so that the thermal decomposition of dioxins is insufficient in the incinerator. This not only may necessitate an increase in the capacity of the incinerator body 201 and that of a subsequent re-combustion chamber (not shown), but also may place an extra burden on subsequent exhaust gas treatment equipment (also not shown).

Moreover, glasses such as syringes, test tubes and medicine bottles that are contained in large amount in wastes are softened and melted at 400 to 700° C., the calcium content contained in various construction materials or plaster casts is softened and melted at 850° C. or higher, and the ash content is melted due to high heat generated by partial combustion of materials with a high heating value including for example plastics such as expanded polystyrene, paper and fibers, thereby often forming solid clinkers.

This has posed the following problems: A blockage situation due to the clinker may occur in the vicinity of the glow layer GL in the lower portion of the incinerator body 201, which impedes the fall of the refuse or the bottom ash BA in the upper portion, leading to a suspension of the operation in order to take away the clinkers. In the case of using a simple single plate structure or refuse supporting plates 204 having no forced cooling means in which a plurality of, for example, comb-shaped supporting rods are provided, the above-described clinkers impede the projection of the refuse supporting plates 204 and may cause damage to the refuse supporting plates 204 in the worst-case scenario.

In addition, when the vertical incinerator is increased in capacity, its strength becomes insufficient due to the cantilever structure of the refuse supporting plates 204 and the refuse supporting plates 204 may be broken and damaged in the case where the clinkers are generated.

Furthermore, at the time of dropping the ash in the lower portion onto the bottom ash discharge plates 205, the thickness of the ash layer AL becomes thin when the amount of incombustible components is small, so that a part of the glow layer GL may be dropped and burnt in the discharge area DA. Or, when unburnt material remains, the unburnt material is broken up by the shock generated during the dropping and similarly burnt in the discharge area DA, so that the clinkers may be generated in the vicinity of the ash layer AL, causing damage to the refuse supporting plates 204 that are projected during the discharge of the bottom ash BA.

On the other hand, since the bottom of the incinerator is completely cooled after the incinerator is out of operation for a long time for a repair work or periodic maintenance work, it requires a long time to increase the temperature in the incinerator from restart to normal operation.

SUMMARY OF THE INVENTION

The present invention provides a vertical refuse incinerator for incinerating industrial wastes, including medical wastes, and general wastes, comprising: an incinerator body having a funnel-shaped lower side wall, a flame zone, a refuse layer, a glow layer and an ash layer being formed in this order inside the incinerator body from top to bottom at the time of combustion; an exhaust gas mixing device for spinning combustion gas that is made of a refractory, that is provided above the incinerator body and that has a plurality of secondary air blow holes for supplying secondary air for re-combustion formed therein, at least a part of the air blow holes being opened toward the flame zone in an upper portion of the incinerator body; a re-combustion chamber placed on the exhaust gas mixing device; a cooling casing covering the exterior of the funnel-shaped side wall; a plurality of primary air nozzles supplying primary air for combustion that are introduced into the incinerator body; a casing that is provided for the ash layer below the incinerator body and that houses retractable refuse supporting means and a closable bottom ash discharge plate disposed below the refuse supporting means with a clearance interposed between the refuse supporting means and the bottom ash discharge plate; and an air duct supplying air for final burning that is incorporated into the casing, wherein, at the time of discharging bottom ash, the refuse supporting means is projected into the ash layer so as to support the load of refuse and bottom ash deposited in the incinerator body, then the closed bottom ash discharge plate is opened so as to discharge the bottom ash retained between the refuse supporting means and the bottom ash discharge plate, followed by closing the bottom ash discharge plate, and then the refuse supporting means are retracted.

In the above-described structure, the refuse supporting means may comprises a supporting means body formed by arranging side by side a plurality of supporting rods in a fitting frame or two of said supporting means bodies in which said supporting means bodies are placed facing each other such that the supporting rods are opposed to one another, cooling means for cooling the supporting means body or bodies with a cooling fluid and an external driver for retractably driving the supporting means body or bodies may be provided, and the external driver may be provided with a supporting means detector comprising pressure detection means and position detection means.

The present invention also provides a vertical refuse incinerator for incinerating industrial wastes, including medical wastes, and general wastes, comprising: an incinerator body having a funnel-shaped lower side wall, a flame zone, a refuse layer, a glow layer and an ash layer being formed in this order inside the incinerator body from top to bottom at the time of combustion; an exhaust gas mixing device for spinning combustion gas that is made of a refractory, that is provided above the incinerator body and that has a plurality of secondary air blow holes for supplying secondary air for re-combustion formed therein, at least a part of the air blow holes being opened toward the flame zone in an upper portion of the incinerator body; a re-combustion chamber placed on the exhaust gas mixing device; a cooling casing covering the exterior of the funnel-shaped side wall; a plurality of primary air nozzles supplying primary air for combustion that are introduced into the incinerator body; a casing that is provided for the ash layer below the incinerator body and that houses an inclined reversible grate that can be reversed from a horizontal position in which bottom ash is deposited and retained to a vertical position in which bottom ash is discharged; and an air duct supplying air for final burning that is incorporated into the casing.

In the vertical refuse incinerator having the above-described structure, sludge drying means may be provided in the incinerator body or in an upper portion of the re-combustion chamber.

Additionally, refuse charging equipment for charging refuse to the incinerator body may be provided and the refuse charging equipment is provided with a space for drying and preheating refuse.

The above-described vertical refuse incinerator may further comprise: a combustion control device for controlling, in accordance with the change in the temperature in the incinerator, an amount of supply of the secondary air, the final burning air, incinerator temperature cooling water and refuse, as well as temperature of an air pre-heater after completion of a combustion operation; a bottom ash discharge control device for operating the bottom ash discharge device under the condition that a temperature of the ash layer has decreased to a set value or lower after a set time has elapsed; and a dioxin-reducing device for completing re-combustion of exhaust gas by controlling the amount of air supplied from the secondary air blow holes formed in the exhaust gas mixing device, in such a manner that an average value of the concentration of carbon monoxide in the exhaust gas is not greater than a set value.

The present invention provides a method for controlling the above-described vertical refuse incinerator, wherein a discharge area temperature detector is provided in a discharge area located between the refuse supporting means and the bottom ash discharge plate, and, when a value detected by the discharge area temperature detector is greater than a set value, an alarm is generated and an opening operation of the bottom ash discharge plate is stopped, while retracting the refuse supporting means; and wherein a supporting means detector is provided in the discharge area, and, when the supporting means detector detects that a resistance of the ash layer is greater than a predetermined value at the time of projecting the refuse supporting means, or that a projecting step of the refuse supporting means is not completed, a cooling fluid is jetted into the ash layer so as to break up a clinker.

DESCRIPTION OF THE PREFERRED EMBODIMENTS

Hereinafter, preferred embodiments of the invention are described with reference to the appended drawings.

Figure 1:
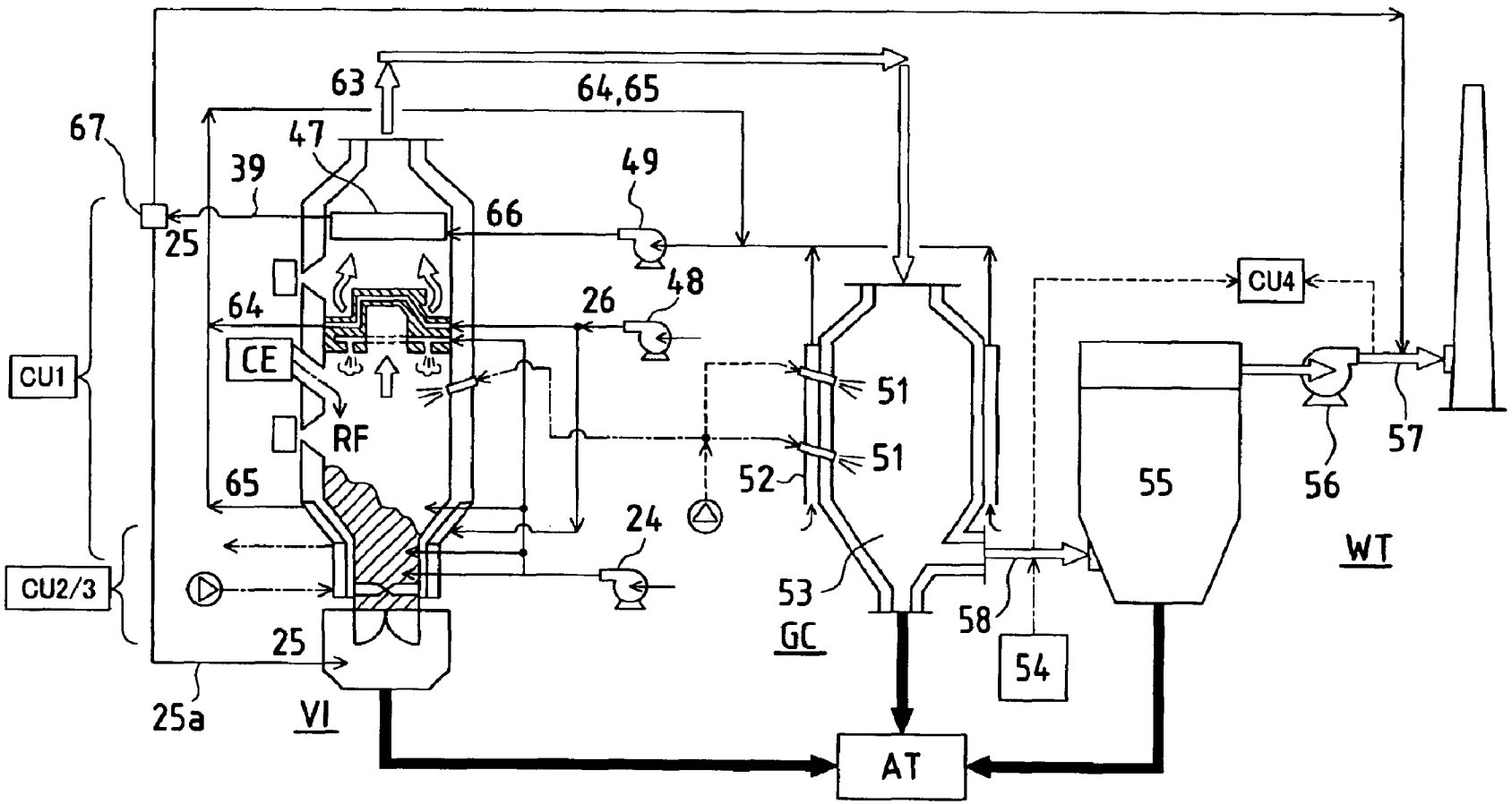
FIG. 1 is a diagram schematically showing the entire structure of a facility in which a vertical refuse incinerator for incinerating wastes according to the present invention is provided.
Figure 2:
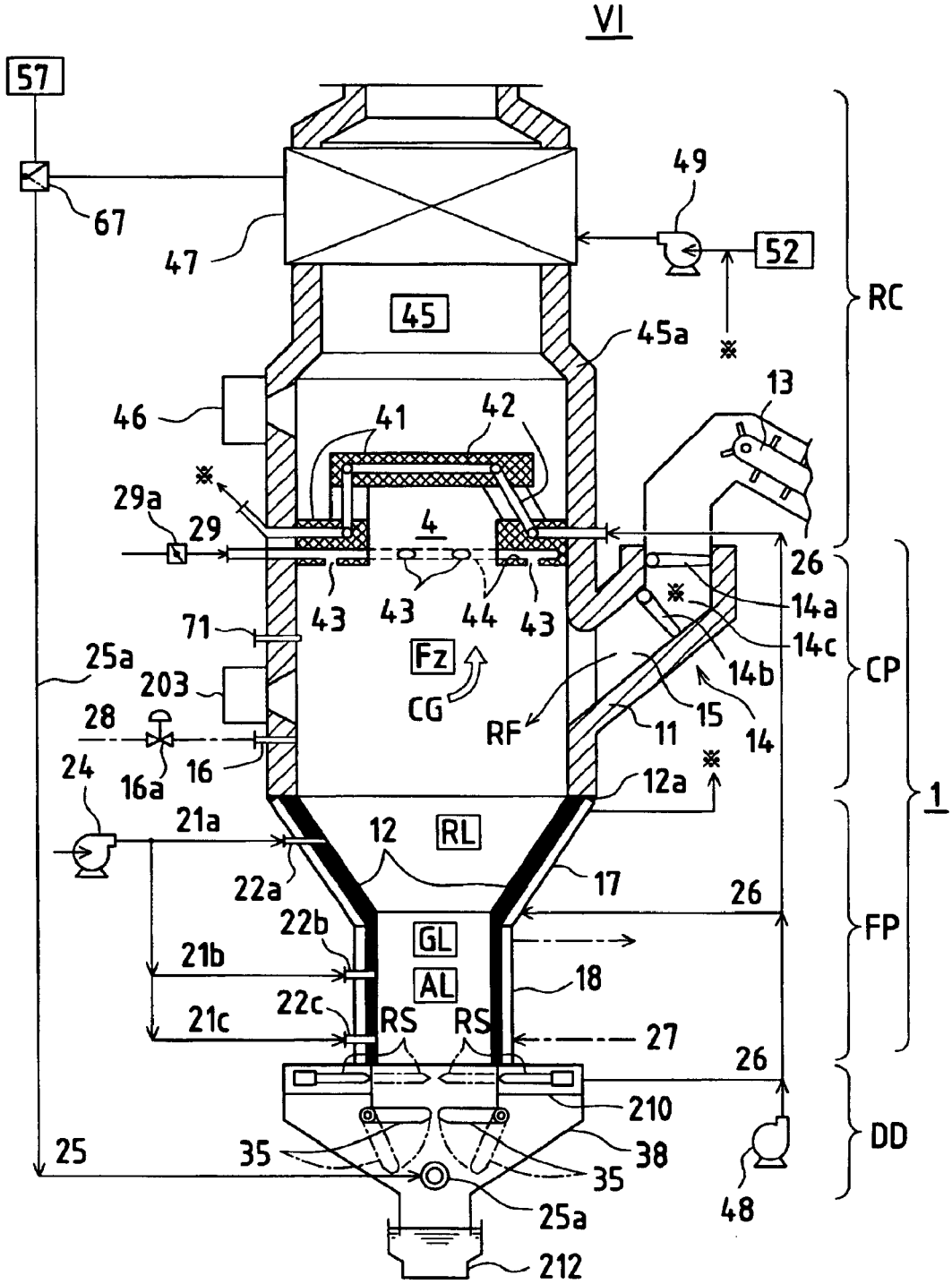
FIG. 2 is a vertical sectional view showing an example of the structure of the same vertical refuse incinerator.
Figure 3:
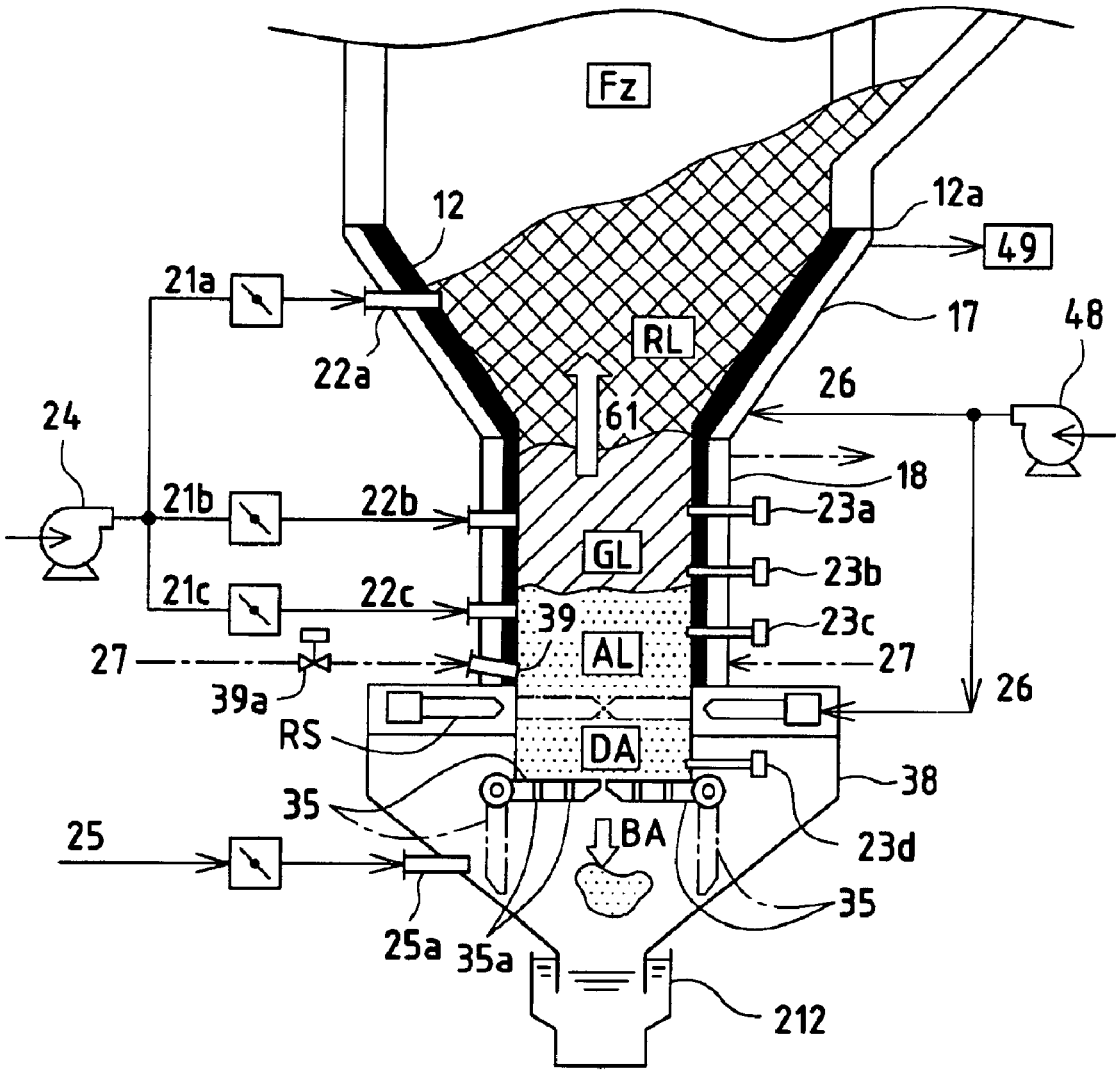
FIG. 3 is a vertical sectional view showing refuse, bottom ash and the distribution of unburnt gas and the like in a lower portion of the same vertical refuse incinerator.
Figure 4:
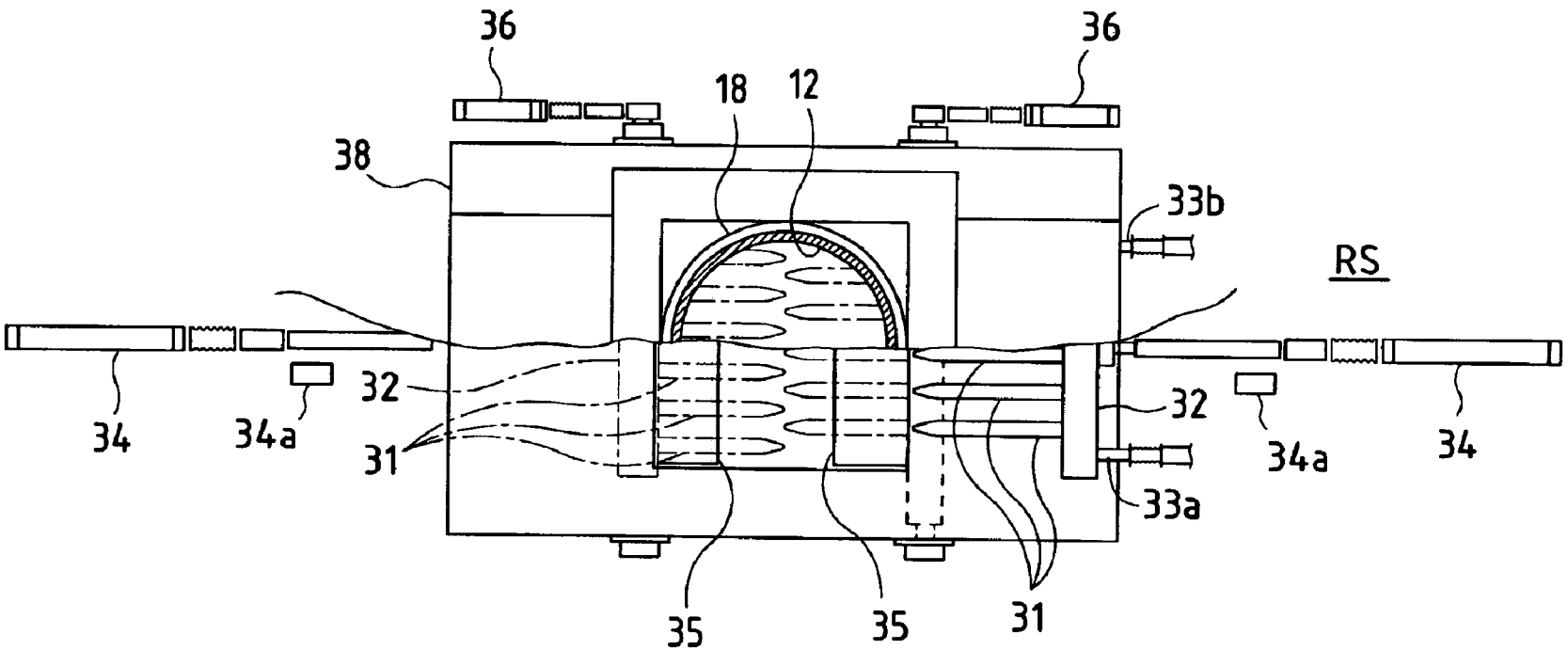
FIG. 4 is a partially broken plan view schematically showing an example of the vicinity of a bottom ash discharge device at the bottom of the same vertical refuse incinerator.
Figure 5:
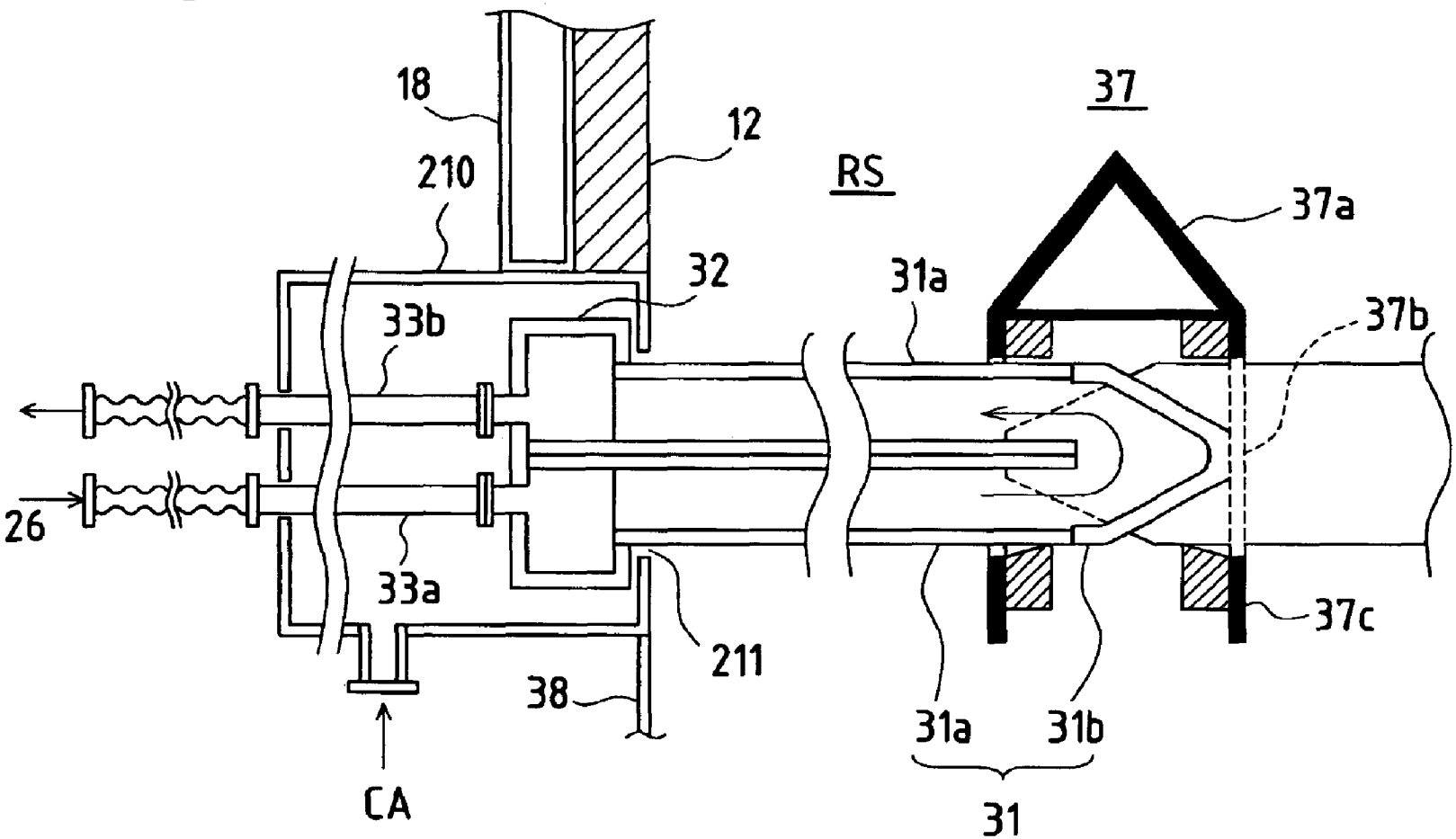
FIG. 5 is a vertical sectional view showing an example of the schematic structure of refuse supporting means.
Figure 10:
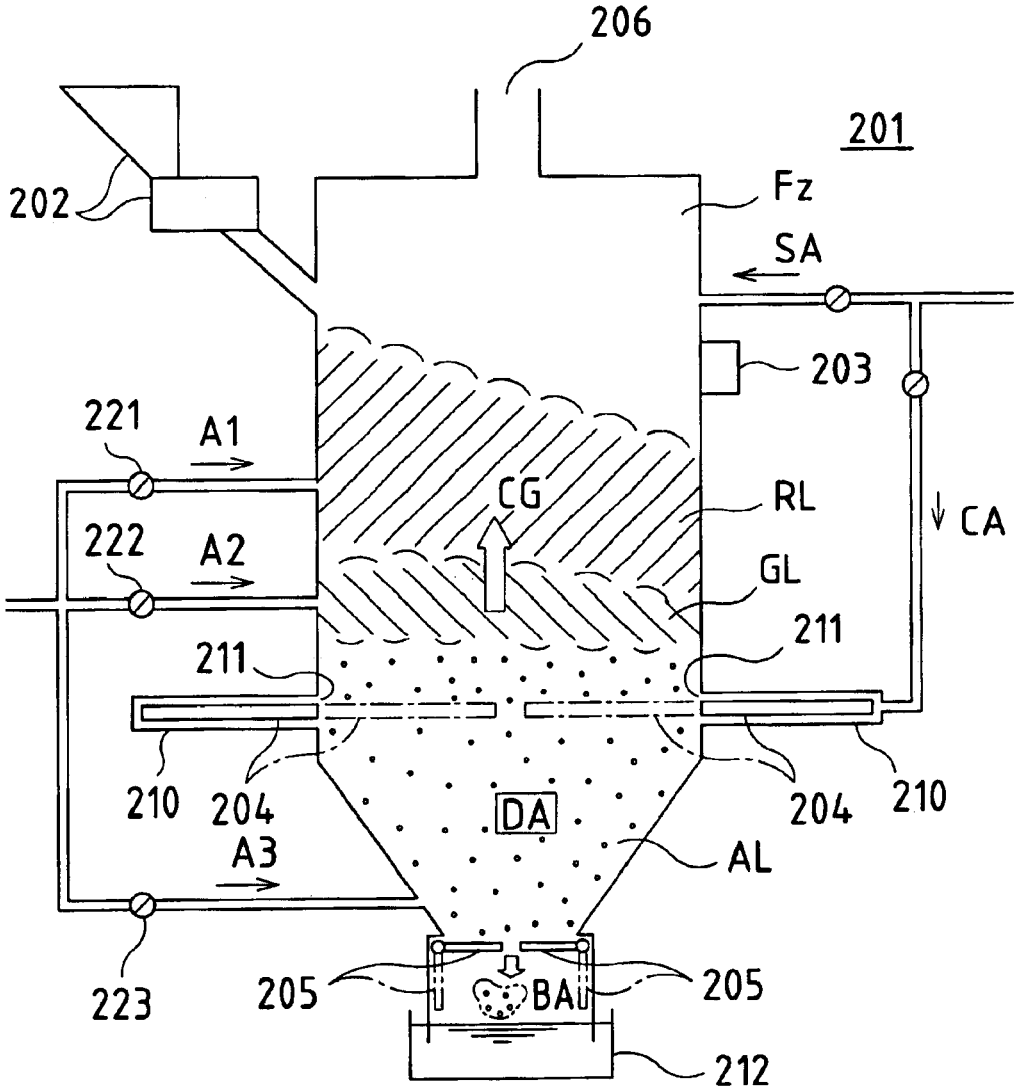
Prior Art Fig.10
FIG. 10 is a vertical sectional view schematically showing a conventional vertical incinerator and an incineration method thereof.

FIG. 1 is a diagram schematically showing the entire structure of a facility in which a vertical refuse incinerator for incinerating wastes according to the present invention is provided; FIG. 2 is a vertical sectional view showing an example of the structure of the same vertical refuse incinerator; FIG. 3 is a vertical sectional view showing refuse, bottom ash and the distribution of unburnt gas and the like in a lower portion of the same vertical refuse incinerator; FIG. 4 is a partially broken plan view schematically showing an example of the vicinity of a bottom ash discharge device at the bottom of the same vertical refuse incinerator; and FIG. 5 is a vertical sectional view showing an example of the schematic structure of refuse supporting means. It should be noted that the same reference numerals are applied to the same components as those described in FIG. 10, and detailed descriptions thereof have been omitted.

As shown in FIG. 1, the vertical refuse incinerating facility for incinerating wastes according to the present invention is composed mainly of refuse charging equipment CE serving to charge industrial wastes, including medical wastes, and general wastes having a wide variety of properties (hereinafter, abbreviated as "refuse RF"); a vertical incinerator VI for burning the refuse RF and re-burning exhaust gas; gas cooling equipment GC for cooling the re-burnt exhaust gas to a temperature suitable for a subsequent bag filter and utilizing the remaining heat; exhaust gas treatment equipment WT includes a bag filter 55 for removing or cleaning dusts and hazardous gas containing dioxins that are contained in the cooled exhaust gas; and an induced draft fan 56; ash treatment equipment AT and a plurality of special control devices CU1 to CU4.

In the following, the schematic structure of the vertical incinerator VI, which is the main feature of this embodiment, is described mainly based on FIGS. 2 and 3 and the structure of the bottom ash discharge device DD of the same vertical incinerator VI is described based on FIGS. 4 and 5, by referring, as necessary, to FIG. 1.

The vertical incinerator VI is made up of an incinerator body 1, a bottom ash discharge device DD, a re-combustion device RC and their associated equipment.

First, the incinerator body 1 is constructed by an upper refractory 11, a lower refractory 12 and steel structures or the like (not shown) enclosing these refractories. The incinerator body 1 has a shape whose upper half is a cylindrical part CP and whose lower half is a funnel part FP, which is narrowed down like a funnel. In addition, the refuse charging equipment CE is provided on the side wall surrounding the flame zone FZ, which is formed in the cylindrical part CP at the time of burning refuse. The refuse charging equipment CE includes: refuse charging means 13 using, for example, a scraper conveyor; a charging controller 14 including, for example, upper and lower double dampers 14*a* and 14*b* with fire resistance and a dry and preheat space 14*c* formed between the double dampers; and a charging chute 15 for the refuse RF. Further, an ignition burner 203, a cooling water nozzle 16, which is jetted when the temperature of the flame zone FZ excessively increases, a camera for monitoring the inside of the incinerator (not shown) is for example disposed on the sidewall of the upper refractory 11.

The funnel part FP is narrowed down like a funnel in order to increase the thickness of the refuse layer to level out the different properties of the refuse. In the funnel part FP, the glow layer GL and the ash layer AL are formed in this order below the refuse layer RL at the time of burning refuse. It should be noted that the positions of these layers (RL, GL and AL) change in a relative manner, depending on the combustion state in the incinerator body 1. Facing these layers, a plurality of primary air nozzles 22*a* to 22*c*, each having an adjusting damper, are disposed, and primary combustion air streams 21*a* to 21*c* that are at room temperature or adjusted to predetermined temperatures are supplied to the layers via the primary air nozzles 22*a* to 22*c*, respectively.

Below the vicinity of a corner part 12*a* located at the upper portion of the lower refractory 12 constituting the side wall of the funnel part FP, the outer surface of is cooled by a cooling casing that is divided into upper and lower parts, i.e., an air cooled jacket 17 and a water cooled jacket 18, for example. The glow layer GL and the ash layer AL are provided with a plurality of temperature detectors 23*a* to 23*d*, as shown in FIG. 3. A forced draft fan 24 for supplying the above-described primary combustion air streams and/or the below-described secondary combustion air streams is disposed outside the incinerator body 1.

The bottom ash discharge device DD is made up of refuse supporting means RS, a supporting rod holder 37, bottom ash discharge plates 35, ash discharger drivers 36 and a casing 38.

The refuse supporting means RS is disposed at the bottom of the incinerator body 1. As shown in FIGS. 4 and 5, the refuse supporting means RS can be readily extended and retracted, like the refuse supporting plates 204 of the prior art, and includes a single supporting means body or a pair of opposing supporting means bodies (a pair is shown) constructed by providing at a fitting frame 32 with a plurality of rows of supporting rods 31, each of which is formed, for example, by stacking two square pipes 31*a*, which are tubes having a hollow structure, in double layers, welding them together and connecting a projected part 31*b* defining a fluid path to the tips of the two pipes, or by providing a separating plate inside a round pipe, in order to impart strength to it. An inlet tube 33*a* and an outlet tube 33*b* for a cooling fluid and a supporting means driver 34 provided with a supporting means detector 34*a* including pressure detection means and position detection means are arranged at both ends of the supporting rod 31, and the refuse supporting means RS is placed in the horizontal orientation.

As shown in FIG. 5, a supporting rod holder 37, into which the tip of the supporting rod 31 is inserted at the time of projection, includes a triangular part 37*a* having cooling means mounted to the casing 38, and a side plate 37*c* having formed therein a plurality of insert holes 37*b* provided at positions facing the above-described plurality of projected parts 31*b*. Both sides of the side plate 37*c* are fixed to the casing 38, and the lower ends are left opened.

As shown in FIG. 3, closable bottom ash discharge plates 35 that have a plurality of draft holes or draft grooves 35*a* and are similar to the bottom ash discharge plates 205 of the prior art are provided next to the discharge area DA below the refuse supporting means RS. As shown in FIG. 4, the casing 38 is provided with the ash discharger drivers 36, which drive the bottom ash discharge plates 35.

As shown in FIG. 3, on the side surface of the casing 38 enclosing the above-described refuse supporting means RS, supporting rod holder 37 and bottom ash discharge plates 35, the temperature detector 23*d* for the discharge area and a final burning duct 25*a* for supplying a high-temperature final burning air 25 are disposed, and the lower part of the casing 38 is inserted into the ash removal conveyor 212 (see FIG. 3).

The re-combustion device RC is made up of an exhaust gas mixing device 4, a re-combustion chamber 45, a re-combustion burner 46, a high-temperature air pre-heater 47 and air fans 48 and 49.

The exhaust gas mixing device 4 is formed on the incinerator body 1, and made up of a refractory 41 constituting a reflecting wall, an air cooling tube 42 housed in the refractory 41 and a secondary air blow tube 44 having a plurality of air blow holes 43. The exhaust gas mixing device 4 has a structure in which the gas path is inclined so as to ensure the spinning of the combustion gas stream CG rising from the flame zone FZ.

The re-combustion chamber 45 constructed of a refractory is placed above the exhaust gas mixing device 4, and a re-combustion burner 46 is provided on a side wall 45*a* of the re-combustion chamber 45. In addition, the high-temperature air pre-heater 47 that is covered with or constructed of a refractory is disposed at the ceiling part of the re-combustion chamber 45. Further, the cooling air fan 48 for sending a cooling air stream 26 into the air cooled jacket 17 of the funnel part FP, the air cooling tube 42 and the compartments 210, and the final burning air fan 49 for sending air into the high-temperature air pre-heater 47 are disposed outside the incinerator body 1.

As shown in FIG. 1, the gas cooling equipment GC including: a gas cooling chamber 53 that has a plurality of water injection nozzles 51 and their associated equipment and is covered with an air cooled casing 52 on its periphery; and waste heat utilization facility (not shown) are provided downstream from the re-combustion device RC, which is connected to the exhaust gas treatment equipment WT including a bag filter 55 having a chemical injection apparatus 54, an induced draft fan 56 and the like, via the gas cooling equipment GC.

Additionally, the exterior of the vertical incinerator VI, the gas cooling equipment GC and the exhaust gas treatment equipment WT are thermally insulated using a heat insulating material or the like (not shown).

Figure 6:
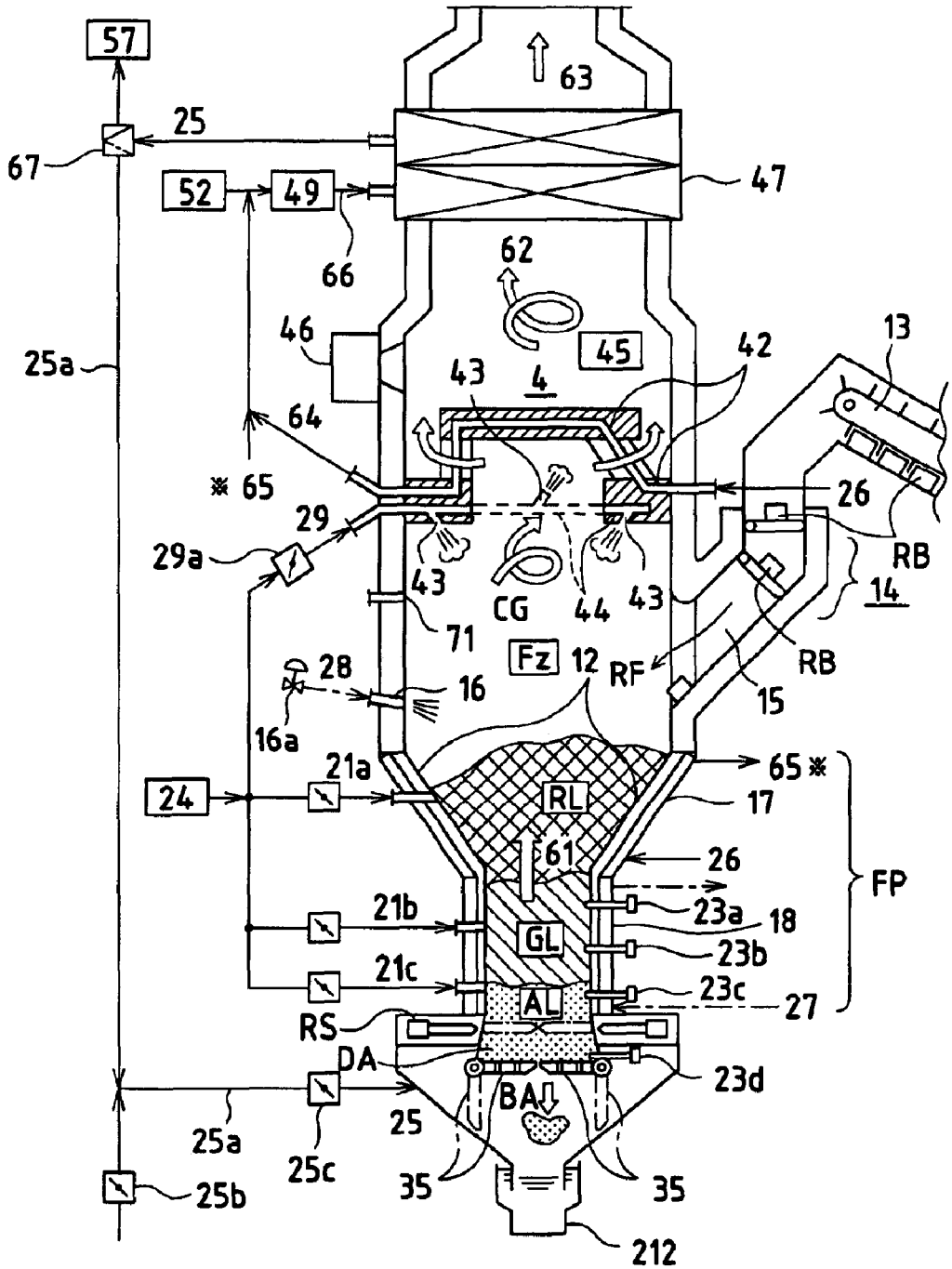
FIG. 6 is a diagram schematically showing a combustion state of wastes and its control in the same vertical refuse incinerator.

Next, the combustion state of wastes in a vertical refuse incinerating facility for incinerating wastes having the above-described structure and the control of the refuse incinerator are described mainly based on FIG. 6, taking medical wastes as a typical example, and referring, as necessary, to FIGS. 1, 3 and 4.

It should be noted that the forming condition of the flame zone FZ, the refuse layer RL, the glow layer GL and the ash layer AL, as well as the combustion state therein until the operation proceeds to normal operation are the same as those in the above-described prior art, so that detailed descriptions thereof have been omitted.

In the case of general wastes, it is common to retain hauled refuse RF in a refuse pit and then to supply the refuse RF to the hopper 202 (see FIG. 10) after agitating it with a refuse crane and leveling out the properties. However, since medical wastes contain infectious materials, sharp materials and the like, it is necessary to protect personnel handling these wastes from possible infection and injury. For this purpose, medical wastes are contained in packages RB marked with biohazard label, and the packages RB containing the medical wastes are charged into the incinerator from the charging chute 15 at predetermined time intervals by the refuse charging means 13 using, for example, a scraper conveyor and by the charging controller 14 using, for example, double dampers. In an abnormal condition, the number of packages RB that are charged into the incinerator from the charging chute 15 is calculated in view of the temperature inside the incinerator.

In a normal operating condition, the radiation heat generated by the secondary combustion of the below-described unburnt gas stream 61 in the flame zone FZ is irradiated on the surface of the refuse layer RL by the reflection on the bottom surface of the exhaust gas mixing device 4. In addition, inside the refuse layer RL, flammable materials having a high heating value, such as plastics, paper and fibers are ignited, gasified and burnt by supply of the primary combustion air stream 21 whose temperature is adjusted and by the heating with the unburnt gas stream 61 rising from the glow layer GL. Consequently, hard-to burn materials such as refuse having a high water content and magazines are dried, and continue to be carbonized and burnt, generating more unburnt gas stream 61, together with flammable materials.

At this time, since the exterior of the upper portion of the lower refractory 12 is slowly cooled by the air cooled jacket 17 that is cooled with the cooling air stream 26, the surface temperature of the lower refractory 12 can be maintained at about 700° C. or lower. As a result, the combustion in the funnel part FP is not hindered, and the welding of clinkers onto the surface of the lower refractory 12 due to partial combustion of the flammable materials can be prevented.

The glow layer GL is an area for ember-burning over a long period of time unburnt carbonized materials and hard-to burn materials that could not be burnt in the refuse layer RL, with heat rising from the below-described ash layer AL and by receiving supply of the primary combustion air streams 21*b* and 21*c* whose temperatures are adjusted, and the unburnt gas stream 61 is generated by the ember-burning.

At this time, the surface temperature of the lower portion of the lower refractory 12 is maintained at 400 to 500° C. due to the cooling effect of the water cooled jacket 18 that is cooled with jacket cooling water 27. This is combined with the above-described effect of the air cooled jacket 17, preventing the welding and solidification of glass melts and the like onto the surface of the lower refractory 12.

The ash layer AL is an area for completely burning any remaining unburnt carbonized materials to bottom ash BA, by supplying the final burning air stream 25 that is heated to 350 to 450° C. by the high-temperature air pre-heater 47 and whose temperature is adjusted to about 150 to 250° C. by mixing room air from an air damper 25*b* through the draft holes or draft grooves of the bottom ash discharge plates 35 from below, and for supplying heat to the glow layer GL located above by cooling the bottom ash BA. The bottom ash BA located in the discharge area DA below the ash layer AL has been cooled to about 450° C. by the cooling effect of the passing through of the above-described final burning air stream 25 and the water cooled jacket 18, and retained in the discharge area DA by the operations of the refuse supporting means RS and the bottom ash discharge plates 35 until it is discharged to the ash removal conveyor 212.

On the other hand, in the above-described normal operating condition, the high-temperature unburnt gas stream 61 generated in the glow layer GL and the lower portion of the refuse layer RL rises, while absorbing the entrained fine particles such as fly ash, when passing through the refuse layer RL. In addition, the heat of the unburnt gas stream 61 facilitates ignition and gasification of refuse in the upper portion and dries the refuse RF. Then, the unburnt gas stream 61 that has risen to the flame zone FZ is subjected to the secondary combustion with the secondary combustion air stream 29 whose temperature is at room temperature or adjusted that is supplied from the air blow hole 43 to the upper portion of the flame zone FZ, and turns to the combustion gas stream CG. This combustion gas stream CG spins in a spiral fashion, which prolongs its retention time in the flame zone FZ. Consequently, a re-combustion in the incinerator is performed for the purpose of thermal decomposition of dioxins.

Furthermore, the combustion gas stream CG passes through the exhaust gas mixing device 4, thereby entering into the re-combustion chamber 45, while spinning, and turns into a re-combustion gas stream 62 in which the remaining dioxins have been subjected to complete thermal decomposition by the effect of the prolonged retention time achieved by effectively utilizing the capacity of the re-combustion chamber with the spinning movement, and by a flame radiation of the re-combustion burner 46, which is actuated when the temperature decreases. Further, when passing through the high-temperature air pre-heater 47, the re-combustion gas stream 62 is subjected to heat exchange and thus turns into an exhaust gas stream 63 at a decreased temperature, which is sent into a gas cooling chamber 53 used in the next step.

At this time, the exhaust gas mixing device 4 is constantly cooled with the cooling air stream 26 that is sent into the air cooling tube 42 housed therein. An exhaust air stream 64 generated after the cooling is sent to the suction side of the final burning air fan 49, along with exhaust air generated after cooling the air cooled jacket 17.

The atmospheric air sucked in by the final burning air fan 49 is increased in temperature by about 40 to 50° C. when passing through the air cooled casing 52 that cools the refractory on the inner surface of the gas cooling chamber 53. This atmospheric air and the exhaust air streams 64 and 65 generated after the cooling turn into a middle temperature air stream 66, which is supplied to the high-temperature air pre-heater 47 via the final burning air fan 49. The middle temperature air stream 66 is increased in temperature to about 350 to 450° C. by the high-temperature air pre-heater 47 and supplied as the final burning air stream 25 to the ash layer AL via a final burning air change damper 67 equipped to the final burning duct 25*a* in the usual condition. However, the operation of the final burning air fan 49 is continued also after stopping the incinerating operation, and the middle temperature air stream 66 is released into the atmosphere via the final burning air change damper 67 that has been switched to the exhaust gas flue 57 side, after cooling the high-temperature air pre-heater 47 (see FIG. 1).

Here, in the case of incinerating high water content sludge delivered from sewage treatment plants or human excreta treatment plants when it is mixed with other industrial wastes, the upper refractory 11 of the incinerator body 1 or the side wall 45*a* of the re-combustion chamber 45, which are upright as shown in FIGS. 2 and 6, may be partly remodeled to provide a structure that allows the deposition and transfer or the slow flow of the sludge by forming a horizontal part or inclined part, thereby providing sludge drying means for lowering the water content of sludge by utilizing the high heat of the refractory whose temperature has been increased with the combustion gas stream CG, the re-combustion gas stream 62 or the exhaust gas stream 63. By appropriately charging the sludge that has been half-dried by the sludge drying means to the refuse charging means 13, it is possible to decrease the heating value of the refuse RF to some extent, while preventing the sludge from adversely affecting the combustion state in the incinerator.

At the time of restart after the incinerator has been out of operation for a long time, the bottom ash BA is often not deposited and the temperature of the bottom of the incinerator is low, so that the refuse RF intermittently supplied from the refuse charging means 13 is heated by the ignition burner 203, while it is retained on the lower double damper 14*b*. This increases the temperature in the incinerator, thereby drying and preheating the refuse RF so as to be easily ignited. The refuse RF in such a state is deposited on the ash layer AL to create the startup condition, promoting the transition to the normal operation.

Next, the special control procedures other than the above-described control methods will be described. The control methods are described with reference to the block flow charts shown in FIGS. 7 and 8, and the detecting element and the controlling element are described with reference to FIGS. 1 and 6.

Figure 7:
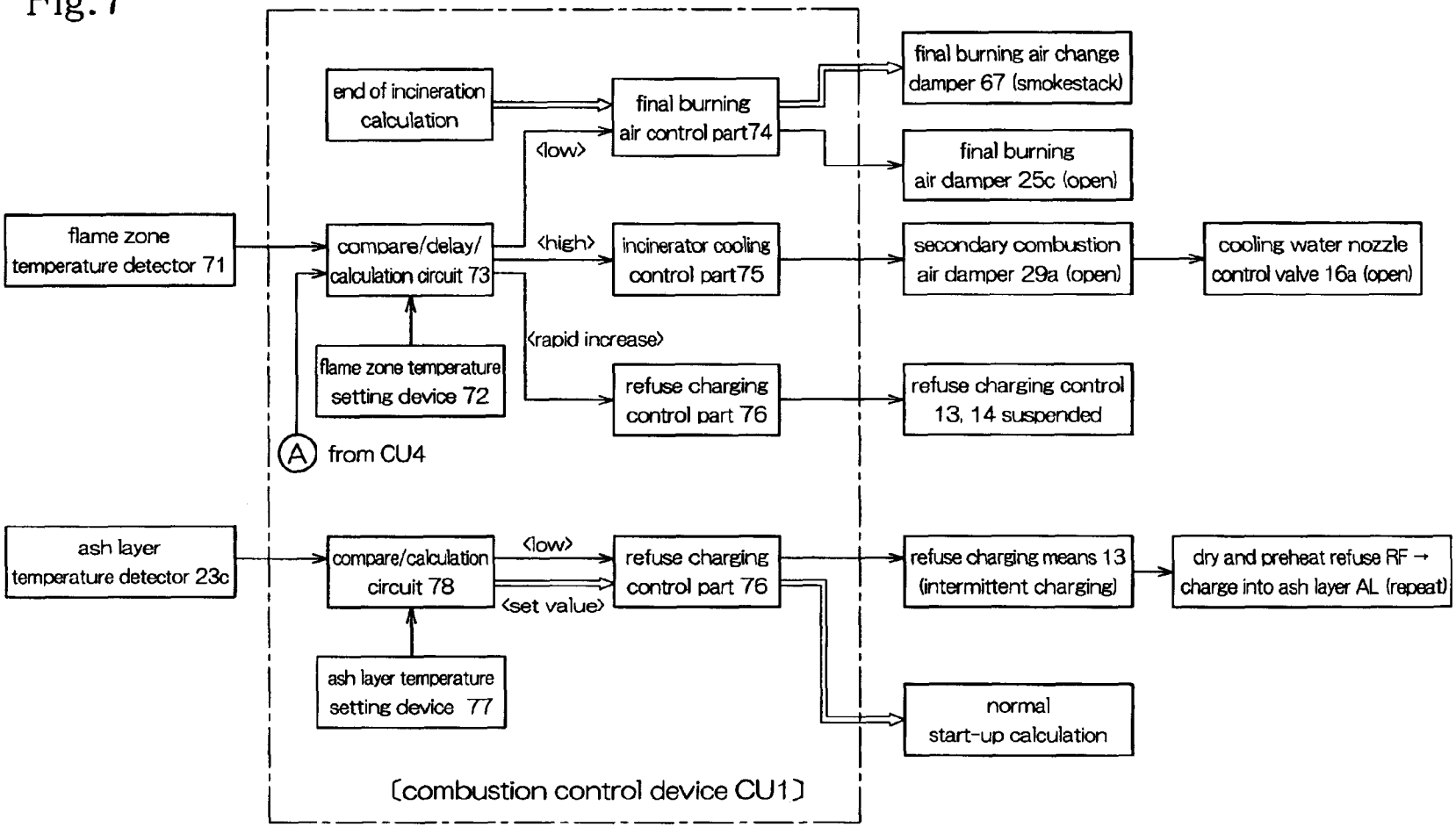
FIG. 7 is a block flow chart for illustrating a control procedure.

As shown in FIG. 7, a combustion control device CU1 performs the control operations other than the normal operation control. More specifically, the combustion control device CU1 compares the average temperature per unit time of the flame zone FZ detected by a flame zone temperature detector 71 with the set value of a flame zone temperature setting device 72, using a compare/delay/calculation circuit 73. When the average temperature is lower than the set value, a final burning air damper 25*c* is opened in accordance with a command from a final burning air control part 74 so as to promote the combustion in the funnel part FP. Alternatively, when the average temperature is higher than the set value, a command is sent to an incinerator cooling control part 75 to open a secondary combustion air damper 29*a* first, thereby increasing the amount of the secondary combustion air stream 29 whose temperature is at room temperature or adjusted. If the temperature continues to increase, the cooling water nozzle control valve 16*a* is opened and jet water 28 is jetted from the cooling water nozzle 16, thereby stabilizing the temperature in the incinerator.

If the temperature in the incinerator rapidly increases further, a command is sent to a refuse charging control part 76 to suspend supply of the packages RB that have been previously supplied at predetermined time intervals, and the above-described temperature increasing measures are carried out thereafter.

At the time of terminating the incinerating operation, a command is sent to the final burning air control part 74 to switch the final burning air change damper 67 to the exhaust gas flue 57 side so as to continue the cooling by the final burning air fan 49, thereby preventing a burnout of the high-temperature air pre-heater 47 by the re-combustion gas stream 62 that is attenuated but still at a high temperature (see FIG. 1).

At the time of the above-described restart, a temperature of the ash layer detected by the temperature detector 23*c* for the ash layer and the set value of an ash layer temperature setting device 77 are compared by a compare/calculation circuit 78, and the refuse RF intermittently supplied by the refuse charging means 13 is retained in the dry and preheat space 14*c* so as to be easily ignited, followed by charging the refuse RF into the ash layer AL. These operations are repeated until the temperature in the ash layer reaches the set value.

Figure 8:
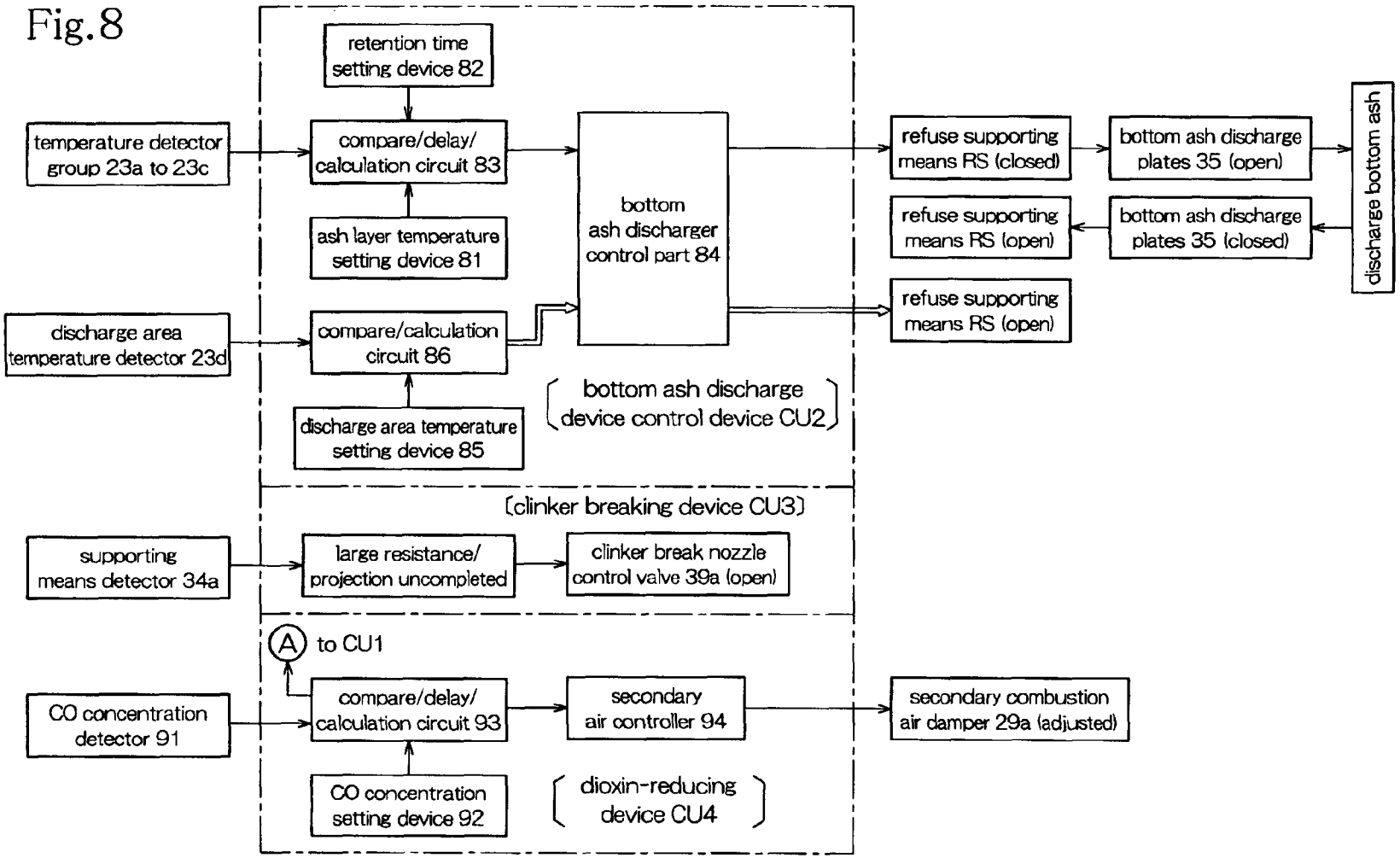
FIG. 8 is a block flow chart for illustrating a control procedure.

As shown in FIG. 8, when the time in which the average temperatures per unit time of the temperature detectors 23*a* and 23*b* inserted into the glow layer glow layer GL and the temperature detector 23*c* inserted into the ash layer AL are lower than the set temperature of an ash layer temperature setting device 81 exceeds the set time of a retention time setting device 82, a bottom ash discharge device control device CU2 sends a command from a compare/delay/calculation circuit 83 to a bottom ash discharger control part 84 to project (close) the refuse supporting means RS and then to open the bottom ash discharge plates 35 so as to discharge the completely burnt bottom ash BA. Thereafter, the bottom ash discharge plates 35 are closed, and then the refuse supporting means RS is retracted (opened) to the initial position (see FIGS. 4 and 6).

Here, the reason why the temperature of the discharge area DA detected by the temperature detector 23*d* for the discharge area is higher than the set value of the discharge area-temperature setting device 85 at the time of projecting the refuse supporting means RS into the ash layer AL by the predetermined step is that the unburnt materials in the bottom ash BA continue to burn in the discharge area DA. Accordingly, the complete combustion of the remaining unburnt materials can be performed by generating an alarm by the bottom ash discharger control part 84, while suspending the normal operation of discharging the bottom ash BA and retracting (opening) the refuse supporting means RS.

In a clinker breaking device CU3, a supporting means detector 34*a* including pressure detection means and position detection means detects that the resistance to the supporting means driver 34 is greater than a predetermined value at the time of projecting the refuse supporting means RS into the ash layer AL, or that the above-mentioned projection step has not been completed. If such detection is made, it can be concluded that a clinker is present in the positions where the supporting rods 31 are projected. In this case, a clinker break nozzle control valve 39*a* is opened to jet the cooling water 27 from a clinker break nozzle 39 into the ash layer AL, thereby breaking up or softening the clinker (see FIGS. 3 and 4).

A dioxin-reducing device CU4 completes the re-combustion, i.e., thermal decomposition of dioxins in the re-combustion chamber 45 by adjusting the jetting amount of the secondary combustion air damper 29*a* in such a manner that the average value per unit time of the values detected by a CO (carbon monoxide) concentration detector 91 inserted into the exhaust gas flue 57 or an exhaust gas duct 58 is lower than the set value of a CO concentration setting device 92, using a secondary air controller 94 that receives a command from a CO concentration compare/delay/calculation circuit 93 that has a precedence over a command from the compare/delay/calculation circuit 73 for the flame zone temperature. In this case, the CO concentration that is most relevant to the dioxin concentration is lowered as the index.

As described above, if the temperature of the flame zone is somewhat increasing at this time, the cooling water nozzle control valve 16*a* is actuated in place of the secondary combustion air damper 29*a*.

Figure 9:
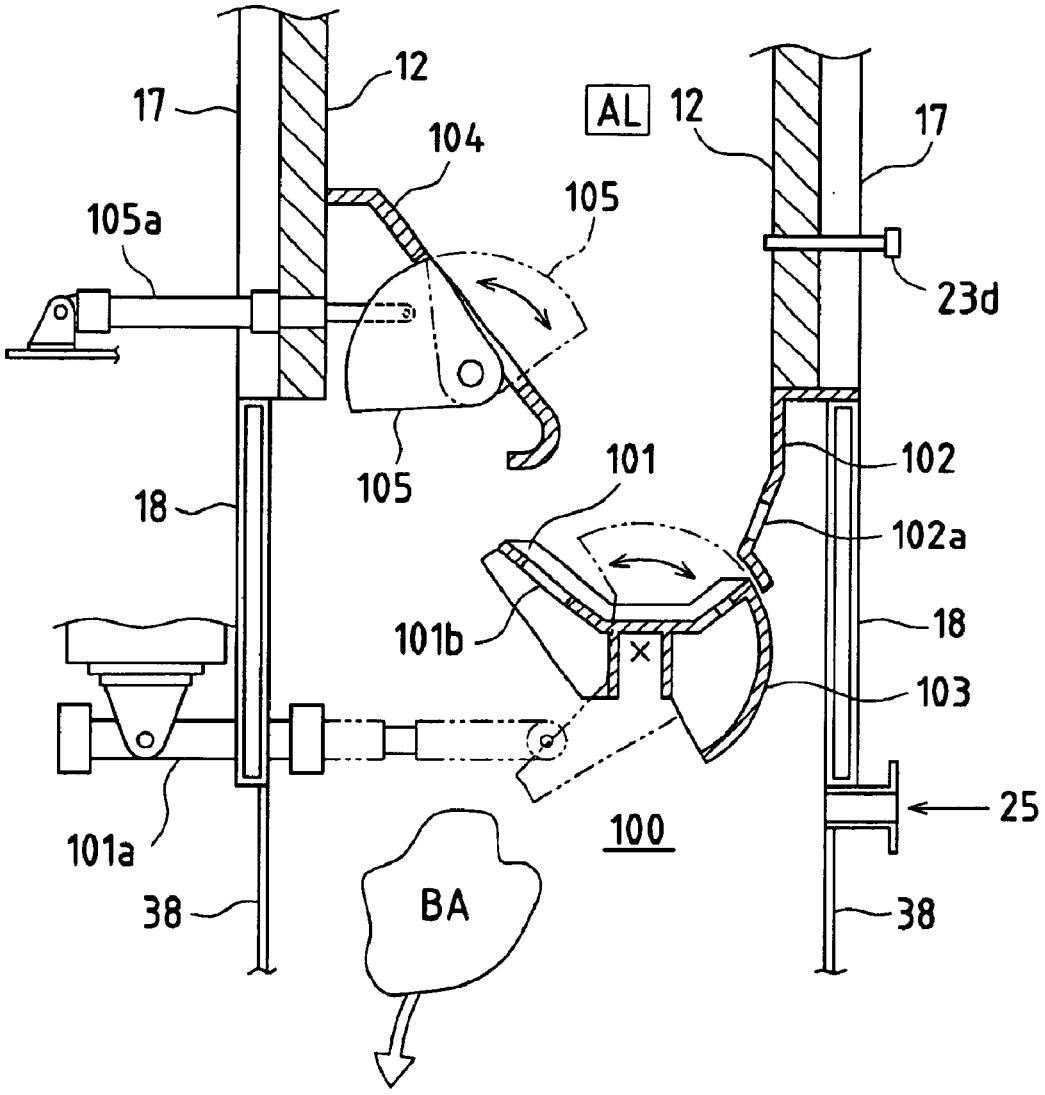
FIG. 9 is a sectional view showing an example of the schematic structure of an inclined reversible grate used in place of the bottom ash discharge device.

In this embodiment, the bottom ash discharge device is not limited to the above-described bottom ash discharge device DD, and an inclined reversible grate 100 can also be employed, as shown in FIG. 9. FIG. 9 is a sectional view showing an example of the schematic structure of the inclined reversible grate 100.

The inclined reversible grate 100 is composed mainly of a saucer 101, an arced plate 103 in contact with a guide plate 102 located above, and a saucer driver 101*a*. The saucer 101 and the guide plate 102 are provided with a plurality of draft holes 101*b* and 102*b* formed therein, and cooled by the water cooled jacket 18 on their periphery. The inclined reversible grate 100 having this structure is retained in the horizontal position indicated by the solid line at the time of deposition, and reversed to the vertical position shown by the imaginary line at the time of discharge.

A guide chute 104 for guiding the bottom ash BA to the inclined reversible grate 100 is disposed on the opposite side of the guide plate 102. A plurality of ash compress means 105 for compressing and crushing any generated clinker and an ash driver 105*a* are retractably provided at the groove portion of the guide chute 104 whose periphery is protected by the lower refractory 12 provided with the temperature detector 23*d* for the ash layer and by the air cooled jacket 17.

The saucer 101, the guide plate 102 and the guide chute 104 are cooled with the final burning air stream 25 supplied from the casing 38 into the draft holes or draft grooves in this manner, and the bottom ash that has been completely incinerated by crushing the clinker can be discharged in a fixed amount without fear of burnout.

It should be noted that it is necessary to use air whose temperature is adjusted for the primary combustion air streams 21*a* to 21*c* and the secondary combustion air stream 29, depending on the property of wastes. In this case, a part of the final burning air streams 25 may be mixed into the necessary places.

In addition, the exhaust air streams 64 and 65 generated after cooling the air cooling tube 42 and the air cooled jacket 17 may be utilized for heating the combustion air, instead of sending them back to the suction side of the final burning air fan 49.

Further, although the cooling casing was described as being the combination of the air cooled jacket 17 and the water cooled jacket 18, the present invention is not limited to such combination and cooling media.

There is no limitation with regard to the structure of the bottom ash discharge device DD, as long as its object is achieved. Although the gas cooling equipment GC is described as water spray type gas cooling system, a waste-heat boiler may also be used.

Additionally, a normal variable speed feeder in which the dry and preheat space 14*c* is not formed may also be used as the charging controller 14.

The present invention can be practiced in various other forms without departing from the sprit or essential characteristics thereof. Therefore, the above embodiments were described in all respects by way of example only and should not be construed as limiting. The scope of the present invention is defined by the appended claims, and is by no means restricted to the text of the specification. Furthermore, all the alterations or modifications covered by the scope of the claims and equivalents thereof fall within the scope of the present invention.

This application is based on Japanese Patent Application 2003-091244 filed in Japan, which is incorporated herein by reference. The entirety of any literature to which reference is made in this specification is specifically incorporated herein by reference.

What is claimed is:

1. A vertical refuse incinerator for incinerating industrial wastes, including medical wastes, and general wastes, comprising:

an incinerator body having a funnel-shaped lower side wall, a flame zone, a refuse layer, a glow layer and an ash layer being formed in this order inside the incinerator body from top to bottom at the time of combustion;

an exhaust gas mixing device for spinning combustion gas that is made of a refractor, that is provided above the incinerator body and that has a plurality of secondary air blow holes for supplying secondary air for re-combustion formed therein, at least a part of the air blow holes being opened toward the flame zone in an upper portion of the incinerator body;

a re-combustion chamber placed on the exhaust gas mixing device;

a cooling casing covering the exterior of the funnel-shaped side wall;

a plurality of primary air nozzles supplying primary air for combustion that are introduced into the incinerator body;

a casing that is provided for the ash layer below the incinerator body and that houses retractable refuse supporting means and a closable bottom ash discharge plate disposed below the refuse supporting means with a clearance interposed between the refuse supporting means and the bottom ash discharge plate; and an air duct supplying air for final burning that is incorporated into the casing, wherein, at the time of discharging bottom ash, the refuse supporting means is projected into the ash layer so as to support the load of refuse and bottom ash deposited in the incinerator body, then the closed bottom ash discharge plate is opened so as to discharge the bottom ash retained between the refuse supporting means and the bottom ash discharge plate, followed by closing the bottom ash discharge plate, and then the refuse supporting means are retracted;

wherein the refuse supporting means comprises a supporting means body formed by arranging side by side a plurality of supporting rods in a fitting frame or two of said supporting means bodies in which said supporting means bodies are placed facing each other such that the supporting rods are opposed to one another;

wherein cooling means for cooling the supporting means body or bodies with a cooling fluid and an external driver for retractable driving the supporting means body or bodies are provided; and wherein the external driver is provided with a supporting means detector comprising pressure detection means and position detection means.

2. The vertical refuse incinerator according to claim 1, further comprising:

a combustion control device for controlling, in accordance with the change in the temperature in the incinerator, an amount of supply of the secondary air, the final burning air, incinerator temperature cooling water and refuse, as well as temperature of an air pre-heater after completion of a combustion operation;

a bottom ash discharge control device for operating the bottom ash discharge device under the condition that a temperature of the ash layer has decreased to a set value or lower after a set time has elapsed; and a dioxin-reducing device for completing re-combustion of exhaust gas by controlling the amount of air supplied from the secondary air blow holes formed in the exhaust gas mixing device, in such a manner that an average value of the concentration of carbon monoxide in the exhaust gas is not greater than a set value.

3. A method for controlling the vertical refuse incinerator according to claim 1, wherein a discharge area temperature detector is provided in a discharge area located between the refuse supporting means and the bottom ash discharge plate, and, when a value detected by the discharge area temperature detector is greater than a set value, an alarm is generated and an opening operation of the bottom ash discharge plate is stopped, while retracting the refuse supporting means; and wherein a supporting means detector is provided in the discharge area, and, when the supporting means detector detects that a resistance of the ash layer is greater than a predetermined value at the time of projecting the refuse supporting means, or that a projecting step of the refuse supporting means is not completed, a cooling fluid is jetted into the ash layer so as to break up a clinker.

4. A vertical refuse incinerator for incinerating industrial wastes, including medical wastes, and general wastes, comprising:

an incinerator body having a funnel-shaped lower side wall, a flame zone, a refuse layer, a glow layer and an ash layer being formed in this order inside the incinerator body from top to bottom at the time of combustion;

an exhaust gas mixing device for spinning combustion gas that is made of a refractory, that is provided above the incinerator body and that has a plurality of secondary air blow holes for supplying secondary air for re-combustion formed therein, at least a part of the air blow holes being opened toward the flame zone in an upper portion of the incinerator body;

a re-combustion chamber placed on the exhaust gas mixing device;

a cooling casing covering the exterior of the funnel-shaped side wall;

a plurality of primary air nozzles supplying primary air for combustion that are introduced into the incinerator body;

a casing that is provided for the ash layer below the incinerator body and that houses retractable refuse supporting means and a closable bottom ash discharge plate disposed below the refuse supporting means with a clearance interposed between the refuse supporting means and the bottom ash discharge plate; and an air duct supplying air for final burning that is incorporated into the casing, wherein, at the time of discharging bottom ash, the refuse supporting means is projected into the ash layer so as to support the load of refuse and bottom ash deposited in the incinerator body, then the closed bottom ash discharge plate is opened so as to discharge the bottom ash retained between the refuse supporting means and the bottom ash discharge plate, followed by closing the bottom ash discharge plate, and then the refuse supporting means are retracted; and further comprising:

a combustion control device for controlling, in accordance with the change in the temperature in the incinerator, an amount of supply of the secondary air, the final burning air, incinerator temperature cooling water and refuse, as well as temperature of an air pre-heater after completion of a combustion operation;

a bottom ash discharge control device for operating the bottom ash discharge device under the condition that a temperature of the ash layer has decreased to a set value or lower after a set time has elapsed; and a dioxin-reducing device for completing re-combustion of exhaust gas by controlling the amount of air supplied from the secondary air blow holes formed in the exhaust gas mixing device, in such a manner that an average value of the concentration of carbon monoxide in the exhaust gas is not greater than a set value.

5. A method for controlling the vertical refuse incinerator according to claim 4, wherein a discharge area temperature detector is provided in a discharge area located between the refuse supporting means and the bottom ash discharge plate, and, when a value detected by the discharge area temperature detector is greater than a set value, an alarm is generated and an opening operation of the bottom ash discharge plate is stopped, while retracting the refuse supporting means; and wherein a supporting means detector is provided in the discharge area, and, when the supporting means detector detects that a resistance of the ash layer is greater than a predetermined value at the time of projecting the refuse supporting means, or that a projecting step of the refuse supporting means is not completed, a cooling fluid is jetted into the ash layer so as to break up a clinker.

6. A vertical refuse incinerator for incinerating industrial wastes, including medical wastes, and general wastes, comprising:

an incinerator body having a funnel-shaped lower side wall, a flame zone, a refuse layer, a glow layer and an ash layer being formed in this order inside the incinerator body from top to bottom at the time of combustion;

an exhaust gas mixing device for spinning combustion gas that is made of a refractory, that is provided above the incinerator body and that has a plurality of secondary air blow holes for supplying secondary air for re-combustion formed therein, at least a part of the air blow holes being opened toward the flame zone in an upper portion of the incinerator body;

a re-combustion chamber placed on the exhaust gas mixing device;

a cooling casing covering the exterior of the funnel-shaped side wall;

a plurality of primary air nozzles supply primary air for combustion that are introduced into the incinerator body;

a casing that is provided for the ash layer below the incinerator body and that houses an inclined reversible grate that can be reversed from a horizontal position in which bottom ash is deposited and retained to a vertical position in which bottom ash is discharged; and an air duct supplying air for final burning that is incorporated into the casing; and further comprising:

a combustion control device for controlling, in accordance with the change in the temperature in the incinerator, an amount of supply of the secondary air, the final burning air, incinerator temperature cooling water and refuse, as well as temperature of an air pre-heater after completion of a combustion operation;

a bottom ash discharge control device for operating the bottom ash discharge device under the condition that a temperature of the ash layer has decreased to a set value or lower after a set time has elapsed; and a dioxin-reducing device for completing re-combustion of exhaust gas by controlling the amount of air supplied from the secondary air blow holes formed in the exhaust gas mixing device, in such a manner that an average value of the concentration of carbon monoxide in the exhaust gas is not greater than a set value.

7. The vertical refuse incinerator according to claim 1, wherein sludge drying means are provided in the incinerator body or in an upper portion of the re-combustion chamber.

8. The vertical refuse incinerator according to claim 1, wherein refuse charging equipment for charging refuse to the incinerator body is provided and the refuse charging equipment is provided with a space for drying and preheating refuse.

* * * * *